US011173379B2

(12) United States Patent
Widdemer

(10) Patent No.: US 11,173,379 B2
(45) Date of Patent: Nov. 16, 2021

(54) SIZE-ADAPTABLE GLOVE

(71) Applicant: Bali Leather Inc., Johnstown, NY (US)

(72) Inventor: John D. Widdemer, Gloversville, NY (US)

(73) Assignee: Bali Leathers Inc., Johnstown, NY (US)

( * ) Notice: Subject to any disclaimer, the term of this patent is extended or adjusted under 35 U.S.C. 154(b) by 774 days.

(21) Appl. No.: 15/714,621

(22) Filed: Sep. 25, 2017

(65) Prior Publication Data

US 2019/0091548 A1 Mar. 28, 2019

(51) Int. Cl.
*A63B 71/14* (2006.01)

(52) U.S. Cl.
CPC ..... *A63B 71/146* (2013.01); *A63B 2209/00* (2013.01)

(58) Field of Classification Search
CPC ..... A41D 19/001; A41D 19/0017; A41D 19/0006; A41D 19/015; A63B 71/141; A63B 71/146; A63B 71/148; B68F 1/00; C14B 1/00
USPC ..... 2/161.1, 0.2, 163, 167, 169, 161.6; 473/205
See application file for complete search history.

(56) References Cited

U.S. PATENT DOCUMENTS 5,920,908 A * 7/1999 Widdemer ..... A41D 19/02 2/159
9,302,171 B1 * 4/2016 Iacono ..... A41D 19/0006
2008/0034468 A1 * 2/2008 Kleinert ..... A41D 19/01582 2/159

* cited by examiner

*Primary Examiner* — Katherine M Moran
(74) *Attorney, Agent, or Firm* — Kaplan Breyer Schwarz, LLP

(57) ABSTRACT

A size-adaptable golf glove comprises a palm side, having a first direction of stretch and a back side, having a second direction of stretch, wherein the first direction of stretch and the second direction of stretch are orthogonal to one another, one being directed to length and the other to width.

21 Claims, 3 Drawing Sheets

SIZE-ADAPTABLE GLOVE

FIELD OF THE INVENTION

This invention relates to the field of golf glove design and manufacture.

BACKGROUND OF THE INVENTION

Although not required for playing the game of golf, most golfers wear a golf glove. The primary reason for doing so is that it enhances a golfer's grip on the golf dub. Being tackier than skin, the glove prevents the dub from slipping or turning in a golfer' hand. The glove also reduces the incidence of blister and callous formation.

The glove—only one is used—is worn on the golfer's "lead" hand, which is the hand that is placed uppermost on the club's grip. For a right-handed golfer, the lead hand is the left hand; for a lefty, it's the right hand. So a right hander wears the glove on the left hand, and a left hander wears it on the right hand.

Golf gloves are designed to fit "like a second skin." Consequently, manufacturers offer gloves in quite a few sizes to accommodate different-size hands: three sizes for children, five sizes for women, and eleven sizes for men (six for "regular" hands and five "cadets" for short-fingered hands), based on hand circumference. And, of course, the gloves are offered for both right-handed players (left-handed glove) and left-handed players (right-handed glove). Coupled with consumer demand for color choice (e.g., white, black, red, tan, etc.), the inventory requirements for golf gloves can be substantial.

Large inventories run counter to current retail-marketing trends, which is to reduce stock, thereby freeing-up space for other products as well as reducing the cost of inventory. This has prompted glove manufacturers to develop "one-size-fits-all" golf gloves. Such a size-adaptable glove enables retailers to offer golf gloves in a variety of colors while keeping inventories at manageable levels. Furthermore, this type of glove is of great benefit to Internet retailers, since a single offering that accommodates all sizes necessarily reduces customer sizing mistakes, thereby reducing returns.

These attractions notwithstanding, most size-adaptable golf gloves do not quite measure up to their single-size brethren. In particular, some size-adaptable gloves require hand assembly wherein many small leather panels (e.g., finger panel, thumb panel, palm panel, back panel, inset panel, wrist panel, etc.) are sewn to a web of stretch fabric. The stretch fabric provides the ability to stretch to accommodate various size hands. The stretch fabric between, for example, the finger panel and the palm panel, enables stretch in the longitudinal direction to accommodate the longer fingers of a bigger hand. The stretch fabric between, for example, the thumb panel and the palm panel, enables stretch across the width of the glove to accommodate a wider hand. The complexity of construction and hand labor involved results in a difficult to manufacture—and therefore costly to manufacture—glove.

Furthermore, the relatively wide (¼ inch or greater) strip of stretch fabric and the concomitant stitching required to secure it to the palm-side panels result in ridges on the surface of the palm. The ridges can be a source of skin irritation for the golfer, and also result in a loss of club feel, which is highly undesirable. Additionally, this wide insert of stretch fabric creates a structural weakness in the portion of the glove that sustains much of the torque generated by swinging a club. Failures in this portion of prior single-sized gloves are commonplace.

In light of the foregoing, there is a need for an improved size-adaptable golf glove.

SUMMARY OF THE INVENTION

The present invention provides a size-adaptable golf glove that avoids some of the costs and disadvantages of one-size-fits-all golf gloves in the prior art.

In accordance with the present teachings, a size-adaptable golf glove has a palm side that is formed from a single panel (i.e., the palm region and four fingers are formed from a single panel) made of leather or synthetic leather (hereinafter collectively referenced "leather"). Among any other benefits, the one-piece panel on the palm side reduces the incidence of skin irritation, the loss of club feel, and avoids the structural weakness caused by a multi-piece palm.

In some embodiments, unidirectional stretch is used in novel fashion to provide a size-adaptable glove. More particularly, in some such embodiments, the stretch in the one-piece palm is oriented to length, rather than to width as in conventional single-size or size-adaptable golf gloves. In these embodiments, the stretch in the back of the glove is oriented in a different direction than that of the palm; that is, it is oriented in a direction that is suitable for accommodating the varying width of a golfer's hand.

By way of background, the leather (skins) processed for gloves have natural, but variable, stretch from one skin to the next because of the individual nature of each animal. This natural stretch is less in length (i.e., neck to tail) and more in width (i.e., flank-to-flank of the animal). Because of the wide variation of stretch from skin to skin, skilled glove cutters must adjust the stretch of each skin to be consistent for proper glove fit. This adjustment is effected by dampening the skins, which relaxes them, and then adjusting and setting the correct amount of stretch. The proper amount of stretch in the leather is about 20% in one direction; in particular, the direction that will ultimately align with the width of a conventional as-assembled glove and minimal stretch in the orthogonal direction, which is the direction that will ultimately align with the length (i.e., wrist to fingers) of the conventional as-assembled glove.

This process, which takes great skill, is referred to as "table cutting." The result is a conventional, sized glove that will expand about 20% in width when the hand is closed and thickens, but will stretch minimally to length (for which there is no need in a conventional glove). The stretch of synthetic leather is produced during its manufacture to mimic the stretch of properly cut natural leather. For example, the one-size-fits all golf gloves offered by Zero Friction, LLC of Oakbrook Terrace, Ill., which are based on the golf glove disclosed in U.S. Pat. No. 9,302,171, use natural synthetic leather that is cut to provide the conventional 20% stretch to width and minimal stretch to length.

Thus, some of the aforementioned embodiments of the invention differ in two ways from existing single-size and one-size-fits-all gloves in terms of the orientation of stretch. First, in some embodiments, the stretch in the palm is oriented to length, rather than to width. Second, the stretch in the back of the glove is oriented in a different direction to that of palm, rather than in the same direction, as is conventional.

If embodiments of the invention were configured so that both the full palm and back of the glove were oriented to stretch to length, the fingers would become long and tight when a hand was inserted. Embodiments of the invention control this undesirable tendency by orienting the stretch of the palm and that of the back of the glove in different directions.

In some embodiments, the stretch in the palm of the glove and the stretch of the back of the glove are oriented orthogonally with respect to one another. That is, in embodiments in which the palm stretches to length, the back of the glove is oriented to stretch to width. In such embodiments, the palm will stretch to length, enabling the glove to adapt to various finger lengths. But the back of the glove will remain firm in length and stretch only to width, thereby accommodating variation in hand width. In some other embodiments, the stretch in the palm is oriented to width and the stretch on the back of the golf glove is oriented to length.

In some embodiments, stretch material is used at the back of the glove (where it will not interfere with a golfer's grip on a golf club or with the durability of the glove) to provide additional stretch, or all of the stretch, required (in the appropriate direction).

In some additional embodiments, rather than or in addition to using leather that stretches to length, narrow, lateral, at least partially overlapping expansion slits are used to provide an appropriate amount of stretch to length.

The relatively longer center and ring fingers have potentially more variation in length, from person to person, than the relatively shorter index and pinky fingers. The inventor recognized that this could be accommodated by overlapping the expansion slits beneath the relatively longer center and ring fingers, but not beneath the relatively shorter index and pinky fingers. Thus, the presence or absence of overlap of the two expansion slits provides a capability to modulate the amount of stretch provided. The expansion slits, which comprise stretch fabric, are preferably disposed "high" on the palm, proximal to the base of the fingers.

In some embodiments, the expansion slits provide all of the longitudinal stretch required. For example, the expansion slits can be used in conjunction with leather that does not substantially stretch in any direction. Or, in some other embodiments, the expansion slits can be used in conjunction with leather in which the stretch is oriented to width. In some yet further embodiments, the expansion slits provide some of the longitudinal stretch required, wherein they are used in conjunction with leather that is oriented to stretch to length. In some of such embodiments, a single expansion slit is used for all fingers. In some other of such embodiments, two partially overlapping slits are used.

As in the prior art, embodiments of the invention provide a different glove(s) for men, women, and children. In some embodiments, there is one glove for all children's sizes and one glove for all women's sizes. For men, in some embodiments, one glove fits small through extra-large (XL); such a glove needs to provide about 1.5 inches (3.8 centimeters) of stretch. In such embodiments, an extra-extra large (XXL) glove, which represents about 2% of the sales of golf gloves, is provided by special order and is not part of normal glove production. In some other embodiments, one glove fits men's small through large, and a second (regular production) glove fits XL and XXL.

In some embodiments, a size-adaptable golf glove in accordance with the invention comprises:

- a palm side, the palm side having a single panel of leather that incorporates both a palm region and four fingers, wherein the single panel of leather comprises a physical adaptation that provides the palm side with significant stretch to length and minimal stretch to width; and
- a back side, the back side being physically adapted to provide significant stretch to width.

In some embodiments, the physical adaptation comprises processing the single panel of leather to provide unidirectional stretch, and orienting the single panel of leather so that the unidirectional stretch is oriented to length. In some other embodiments, the physical adaptation comprises laterally oriented expansion slits.

DETAILED DESCRIPTION

The terms below are provided with the following explicit definitions for use in this disclosure and the appended claims:

- The term "leather" means both natural leather and synthetic leather, unless otherwise specifically indicated.
- The term "about" means+/−15% of a nominal value.
- The term "significant stretch" means stretch of at least about 20% relative to a quiescent, unstretched state.
- The phrase "minimal stretch" means an ability to stretch 2% or less relative to a quiescent, unstretched state.
- The term "longitudinal" or "length", when referring to the direction or orientation of the stretch of a glove, means a direction coincident with an axis extending from the wrist to the fingers.
- The term "width" or "lateral", when referring to the direction or orientation of the stretch of a glove, means a direction coincident with an axis extending from one edge of the hand to the other.
- The phrase "high on the palm" refers to a region above the uppermost point of attachment of the thumb panel to the palm, and below the bottom of the fingers.
- The phrase "to length", when referenced in the context of the direction of stretch (i.e., "stretch to length") means that the glove stretches along its length.
- The phrase "to width", when referenced in the context of the direction of stretch (i.e., "stretch to width") means that the glove stretches along its width.

Figure 1:
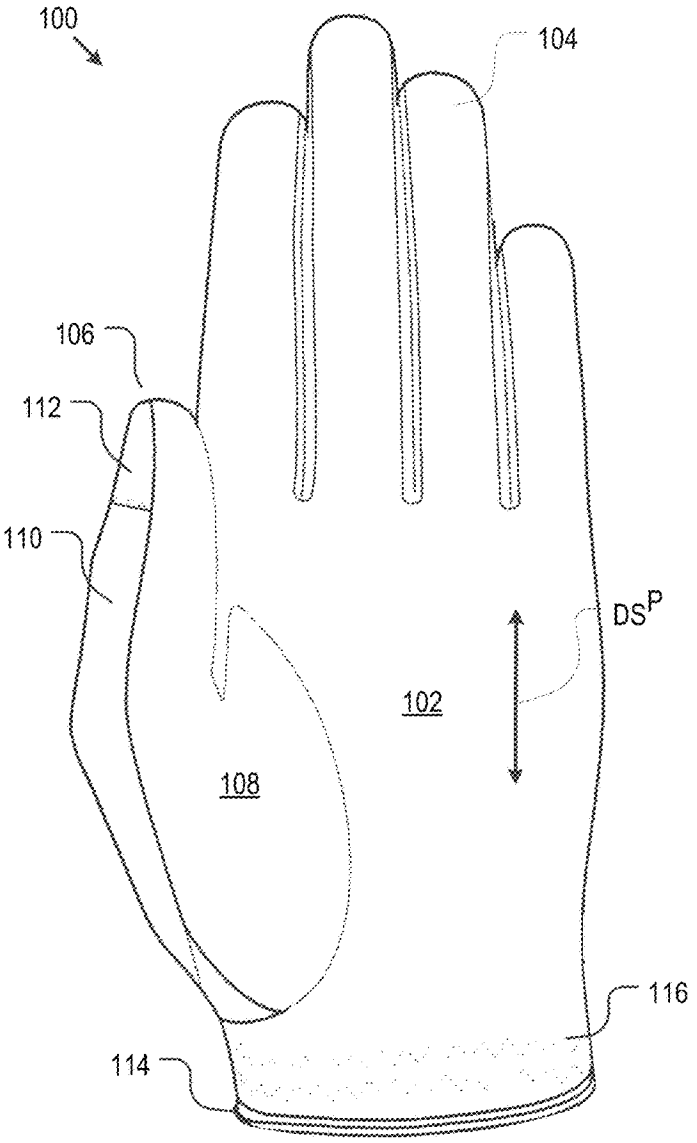
FIG. 1 depicts a first embodiment of the palm side of a size-adaptable glove in accordance with the present teachings.
Figure 2:
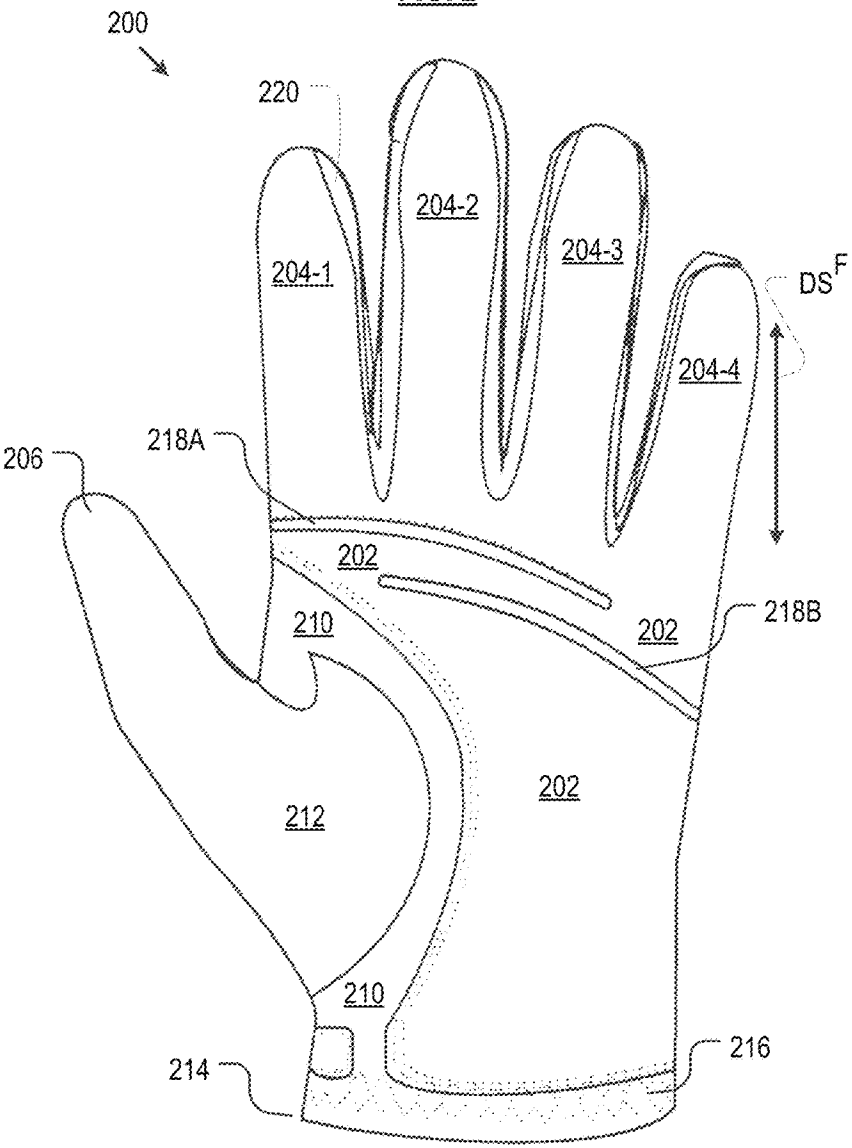
FIG. 2 depicts a second embodiment of the palm side of a size-adaptable glove in accordance with the present teachings.

FIGS. 1 and 2 depict two specific embodiments of the palm side of a size-adaptable glove in accordance with the present teachings. These embodiments include features that are not necessarily required in all embodiments.

FIG. 1 depicts palm side 100 of a size-adaptable glove in accordance with a first embodiment of the invention. Palm side 100 includes palm panel 102, which includes fingers 104. The palm panel is formed from a single piece of leather. In the embodiment depicted in FIG. 1, palm panel 102 is formed from leather that has significant stretch in one direction and minimal stretch in the orthogonal direction, and it is cut so that the significant stretch is oriented to length, as depicted by arrow $DS^P$. In some embodiments, palm panel 102 is textured to improve grip for a wearer.

Thumb 106 is attached (e.g., sewn) to palm panel 102. Thumb 106 comprises portions 108, 110, and 112. Portion 108 comprises the same leather as used for palm panel 102, having the same significant stretch in one direction. It is notable that although the stretch of the thumb, as provided by portion 108, is oriented to length, this direction is askew from the direction of the "length" of the palm panel.

In the embodiment depicted in FIG. 1, portion 110 comprises stretch fabric. The stretch fabric provides the stretch required to accommodate thumbs of different circumference (i.e., the fabric stretches to width, at least). The stretch fabric, can be, for example and without limitation, two-way stretch fabric (stretches in one direction) or four-way stretch fabric (stretches in two orthogonal directions). Examples of stretch fabric include Lycra® (a registered trademark of Invista Corp.) or any number of other brand names and formulations for spandex. Portion 112 is leather, although unlike portion 108, the leather of portion 112 is not oriented to stretch to length.

Binding 114 secures the wrist-end of the glove. Elastic 116 is sewn to the inside of glove near the wrist end. The elastic provides an increased ability for the wrist portion to stretch or contract, thereby facilitating inserting the hand into the glove and also preventing the glove from "riding up" the hand. The elastic may be sewn to the glove via a zig-zag stitch, which can enhance the elasticity of elastic 116.

FIG. 2 depicts palm side 200 of a size-adaptable glove in accordance with an embodiment of the invention. Like palm side 100, palm side 200 includes palm panel 202, which is a single piece of leather that includes fingers 204. In the embodiment depicted in FIG. 2, the leather forming palm panel 102 has minimal stretch both in length and width. Rather, the stretch, which is intended to accommodate the differing lengths of fingers on different sized hands, is provided by partially overlapping, narrow, laterally oriented expansion slits 218A and 218B. As indicated by arrow $DS^P$, the direction of stretch is to length. This arrangement provides stretch for the fingers, but not the palm.

Expansion slits 218A and 218B are located high on the palm region of palm panel 202. This location places them above the point at which the thumb couples to the palm panel and below the base of the fingers (on the palm side and more less aligned with the lowest knuckle of the fingers). The glove experiences the greatest wear and friction in the region beginning just below the location of lower expansion slit 218B. This is the region in which a golf club rests against glove. If an expansion slit were situated in this high-wear region, it would be subject to forces that would quickly compromise it, causing damage to the glove.

Expansion slits 218A and 218B are ⅛ inch to ⅜ inches in width (i.e., the separation in the vertical direction) and comprise a stretch fabric. Upper expansion slit 218A extends laterally from the outer edge of index finger 204-1 to, at a minimum, the edge of ring finger 204-3 closest to pinky finger 204-4. Lower expansion slit 218B extends laterally from the outer edge of pinky finger 204-4 to center finger 204-2. As is apparent from FIG. 2, this arrangement does not section palm panel 202 in to two pieces, which is to be avoided as this would deleteriously effect the integrity of the glove. Depending on actual glove construction, lower expansion slit 218B might not extend to the edge of center finger 204-2 nearest index finger 204-1. In particular, the location of stretch material 210 between thumb 206 and palm panel 202 may be such that if lower slit 218B were to run to the edge of center finger 204-2, the slit would fully section palm panel 202, resulting in two panels.

In the embodiment depicted in FIG. 2, expansion slits 218A and 218B overlap below center finger 204-2 and ring finger 204-3, but not under index finger 204-1 and pinky finger 204-4. This accommodates the relatively greater variation in length, from individual to individual, in the center and ring fingers, by providing for a greater amount of stretch to length for those fingers, relative to the index and pinky fingers. Depending the configuration of palm side 200, the two expansion slits could overlap beneath all fingers (although the slits could not extend from one edge of the palm to the other, since this would section the palm panel). However, since overlap of all four fingers is not necessary, it is preferable not to laterally extend the expansion slits to that degree, since that may affect the integrity of the glove.

In the embodiment depicted in FIG. 2, gussets 220 comprise stretch fabric. The gussets (not depicted) for fingers 104 of FIG. 1 can also comprise stretch fabric.

In the illustrative embodiment depicted in FIG. 2, thumb 206 is separated from palm panel 202 via stretch fabric 210. Although not required, it improves the ability of this embodiment of a size-adaptable golf glove to stretch to width.

Binding 214 secures the wrist-end of the glove. Stretch material, contiguous with that separating thumb 206 from palm panel 202, continues below the palm panel. Elastic 216 is sewn to the inside of glove near the wrist end. The elastic enhances the ability of the stretch material to stretch or contract, thereby facilitating inserting the hand into the glove and also preventing the glove from "riding up" the hand. The elastic may be sewn to the glove via a zig-zag stitch.

Figure 3:
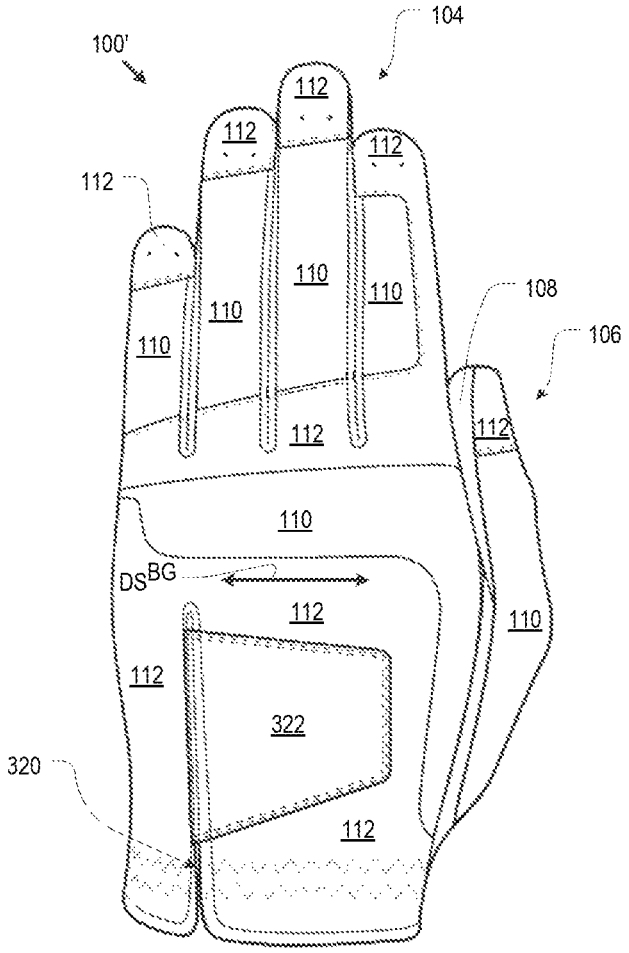
FIG. 3 depicts an embodiment of the back (dorsal) side of a size-adaptable glove suitable for use in conjunction with the palm side depicted in FIG. 1.
Figure 4:
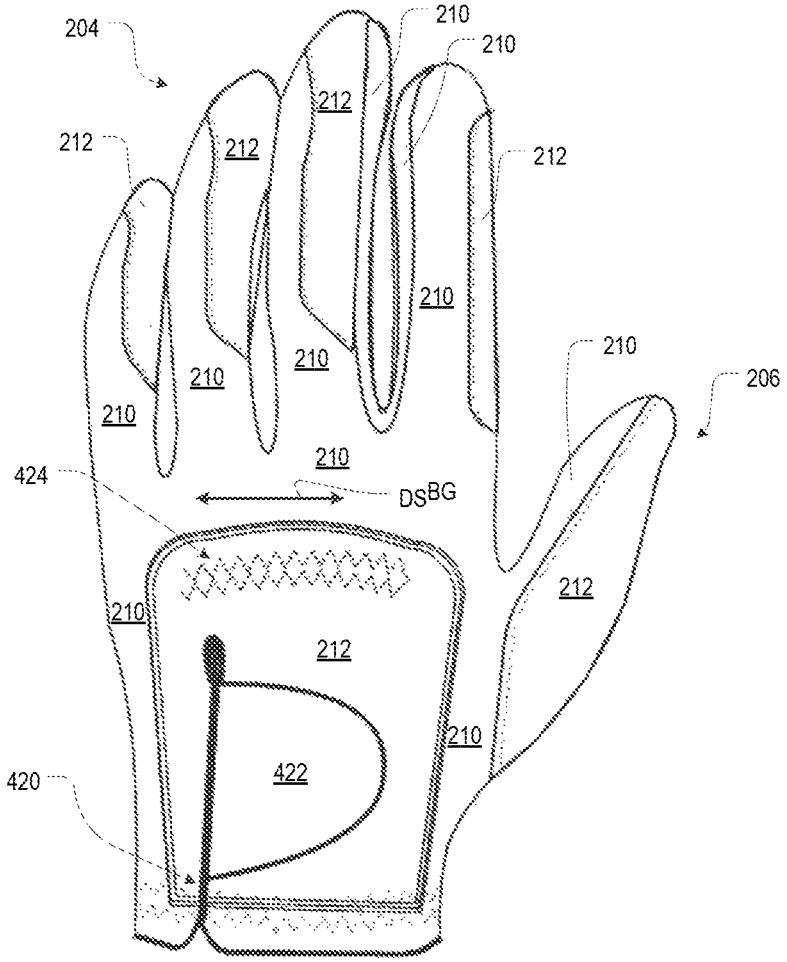
FIG. 4 depicts an embodiment of the back (dorsal) side of a size-adaptable glove suitable for use in conjunction with the palm side depicted in FIG. 2.

FIGS. 3 and 4 depict embodiments of the back of glove, such as can be used with respective palm side 100 and palm side 200 of size-adaptable gloves in accordance with the present teachings. It is to understood that other configurations for the back of the glove may suitably be used with palm sides 100 and 200. What is important about pairing any palm side and with any back side is that the paired two sides must collectively provide the requisite stretch for the glove; that is, both stretch to length and stretch to width.

Turning now to FIG. 3, this figure depicts back 100' of size-adaptable glove for use with palm side 100. The back of the glove includes portions of stretch fabric 110 and panels of leather 112. Since in the embodiment of palm side 100 depicted in FIG. 1, palm panel 102 is oriented to stretch to length, leather 112 on back side 100' is oriented to stretch to width, as depicted by arrow $DS^{BG}$. Stretch fabric 110 must provide stretch to width. In some embodiments, stretch fabric 110 provides stretch to length, in addition to stretch to width.

In the embodiment depicted in FIG. 3, back 100' includes slit 320, which facilitates inserting the hand and removing the hand from the glove. Slit 320 is closed via flap 322, which implements a hook-and-loop closure (e.g., Velcro®, etc.). For example, a swatch of loop material is attached to the glove-facing side of flap 322 and a swatch of hook material is attached to surface of the leather that opposes flap 322.

FIG. 4 depicts back 200' of size-adaptable glove for use with palm side 200. The back of the glove includes portions of stretch fabric 210 and panels of leather 212. Stretch fabric 210 provide stretch to width, as depicted by arrow $DS^{BG}$ and, in some embodiments, stretch to length. In some embodiments, leather 212 provides stretch to width; in some embodiments, leather 212 provides minimal stretch to length and width.

Elastic 424, which may be sewn to the glove-facing surface of the leather 212, provides stretch or supplementary stretch to width.

In the embodiment depicted in FIG. 4, back 200' includes slit 420, which facilitates inserting the hand and removing the hand from the glove. Slit 420 is closed via flap 422, which implements a hook-and-loop closure (e.g., Velcro®, etc.).

It is to be understood that the disclosure teaches just a few embodiments and that many variations of the invention can easily be devised by those skilled in the art after reading this disclosure and that the scope of the present invention is to be determined by the following claims.

What is claimed:

1. A size-adaptable golf glove, comprising:

a palm side, the palm side having a single panel of leather that incorporates both a palm region and four fingers, wherein the single panel of leather comprises a physical adaptation that provides the palm side with significant stretch to length and minimal stretch to width; and a back side, the back side being physically adapted to provide significant stretch to width.

2. The size-adaptable golf glove of claim 1 wherein the physical adaptation comprises processing the single panel of leather to provide unidirectional stretch, and orienting the single panel of leather so that the unidirectional stretch is oriented to length.

3. The size-adaptable golf glove of claim 2 wherein the single panel of leather is textured.

4. The size-adaptable golf glove of claim 2 further comprising a thumb attached to the single panel.

5. The size-adaptable golf glove of claim 4 wherein the thumb comprises leather that provides unidirectional stretch, wherein the leather is oriented so that the unidirectional stretch is oriented to a length of the thumb.

6. The size-adaptable golf glove of claim 5 wherein the thumb includes three portions, a first of which is the leather that provides unidirectional stretch, a second of which is a stretch fabric that stretches at least to width, and a third of which is leather than is not oriented to stretch to the length of the thumb.

7. The size-adaptable golf glove of claim 2 wherein the back side of the glove further comprises a slit that is oriented in the direction of the long axis of the glove, and a flap by which the slit is closed.

8. The size-adaptable golf glove of claim 2 wherein the back side of the Glove consists essentially of leather and stretch fabric, wherein the leather on the back of the glove provides unidirectional stretch and wherein the leather is oriented so that the unidirectional stretch is to width, and wherein the stretch fabric stretches to at least width.

9. A size-adaptable golf glove, comprising:

a palm side, the palm side consisting of a palm panel that incorporates both a palm region and four fingers, wherein the palm panel consists of a single piece of leather having a unidirectional stretch, wherein the palm panel is oriented so that the unidirectional stretch is to length; and a back side, the back side comprising leather that provides stretch to width.

10. The size-adaptable golf glove of claim 9, wherein the back side of the gloves consists of two panels of leather separated by stretch fabric that stretches at least to width.

11. The size-adaptable golf glove of claim 9, wherein on the back side of the glove, for three of the fingers, leather is disposed at a tip thereof and a base thereof, wherein stretch fabric interposes the leather at the tip and base of each finger.

12. The size-adaptable golf glove of claim 9 wherein the palm panel is textured.

13. The size-adaptable golf glove of claim 9 further comprising a thumb attached to the palm panel.

14. The size-adaptable golf glove of claim 13 wherein the thumb comprises leather that provides unidirectional stretch, wherein the leather is oriented so that the unidirectional stretch is oriented to a length of the thumb.

15. The size-adaptable golf glove of claim 12 wherein the thumb includes three portions, a first of which is the leather that provides unidirectional stretch, a second of which is a stretch fabric that stretches at least to width, and a third of which is leather than is not oriented to stretch to the length of the thumb.

16. A size-adaptable golf glove, comprising:

a palm side, the palm side consisting of a palm panel that incorporates both a palm region and four fingers, wherein the palm panel consists of a single piece of leather having a unidirectional stretch, wherein the palm panel is oriented so that the unidirectional stretch is to length;

a thumb attached to the palm panel, the palm-facing side of the thumb consisting of leather essentially of leather; and a back side, the back side comprising leather that provides stretch to width.

17. The size-adaptable golf glove of claim 16 wherein the back side of the thumb consists essentially of leather at the tip thereof, and stretch fabric below the tip.

18. The size-adaptable golf glove of claim 17 wherein the leather at the tip of the thumb on the backside thereof does not stretch to length.

19. The size-adaptable golf glove of claim 16 wherein the back side of the fingers comprise leather at the tips thereof, leather at the base thereof, and stretch fabric therebetween.

20. The size-adaptable golf glove of claim 16 wherein the back of the glove further comprises a slit that is oriented in the direction of the long axis of the glove, and a flap by which the slit is closed.

21. A size-adaptable golf glove, comprising a palm side, the palm side consisting of a palm panel that incorporates both a palm region and four fingers, wherein the palm panel consists of a single piece of leather having a unidirectional stretch, wherein the palm panel is oriented so that the unidirectional stretch is to length.

* * * * *